United States Patent [19]

Moller

[11] 4,324,343

[45] Apr. 13, 1982

[54] FOLDED TAB

[75] Inventor: Jens L. Moller, Darien, Ill.

[73] Assignee: The Continental Group, Inc., Stamford, Conn.

[21] Appl. No.: 197,720

[22] Filed: Oct. 16, 1980

[51] Int. Cl.[3] ..... B65D 17/34

[52] U.S. Cl. ..... 220/270; 220/359; 220/260; 229/43

[58] Field of Search ..... 220/270, 269, 359, 260; 229/7 R, 43 R; 222/541, 485

[56] References Cited

U.S. PATENT DOCUMENTS 3,892,351 7/1975 Johnson et al. ..... 229/43
3,908,857 9/1975 Chiappe ..... 220/260 X
3,961,566 6/1976 Westphal et al. ..... 220/359 X

*Primary Examiner*—George T. Hall
*Attorney, Agent, or Firm*—Charles E. Brown

[57] ABSTRACT

A tab for releasably closing a dispensing opening in a container panel. The tab is particularly adapted for use in conjunction with circular end units, and the tab is provided with fold lines in opposite edge portions of the grip portion of the tab so as to permit the grip portion to be of the required material width while at the same time reducing the effective length of the bend or fold line between the grip portion and the tab body portion thereby permitting the fold line to be disposed closely adjacent the periphery of the end panel of the end unit.

2 Claims, 7 Drawing Figures

FOLDED TAB

This invention relates in general to new and useful improvements in tabs for closing dispensing openings in containers, which tabs are normally heat sealed to an underlying container panel having a dispensing opening therein.

Normally the dispensing openings are formed in end panels of container end units which are circular in outline and wherein the dispensing opening is disposed immediately adjacent the periphery of the end panel. Further, tabs of the type to which this invention relates have a grip portion which is integrally formed with the body portion of the tab and which grip portion is folded relative to the body portion so as to overlie the body portion. The length of the fold line joining the grip portion to the body portion controls the spacing of the tab from the adjacent periphery of the end panel in that at a minimum the fold line becomes a chord line.

In accordance with this invention it is proposed to provide the tab with gussets in its folded state, which gussets are primarily formed in the grip portion and are disposed immediately adjacent to the body portion and wherein the gussets reduce the length of the fold line between the grip portion and the body portion.

The tab of this invention is particularly beneficial when the body portion is circular and conforms substantially to the end panel. When the tab is of this configuration, each gusset is triangular in outline and has one edge thereof which is substantially tangential to an adjacent portion of the body portion.

The tab also has the beneficial effect of the folding to form the gussets aiding in keeping the grip portion of the tab from projecting up after the folding thereof to lie flat in overlying relation to the body portion.

With the above and other objects in view that will hereinafter appear, the nature of the invention will be more clearly understood by reference to the following detailed description, the appended claims, and the several views illustrated in the accompanying drawings.

IN THE DRAWINGS

FIG . 1 is a plan view of a tab formed in accordance with this invention, and wherein the lines along which the tab is to be bent or folded as shown in dotted line form.

This invention particularly relates to a tab wherein the body portion therof is circular in outline, although the advantageous features of the tab may be utilized in other tab configurations including tabs wherein the tab is of a constant width throughout the grip portion and the body portion.

Figure 1:
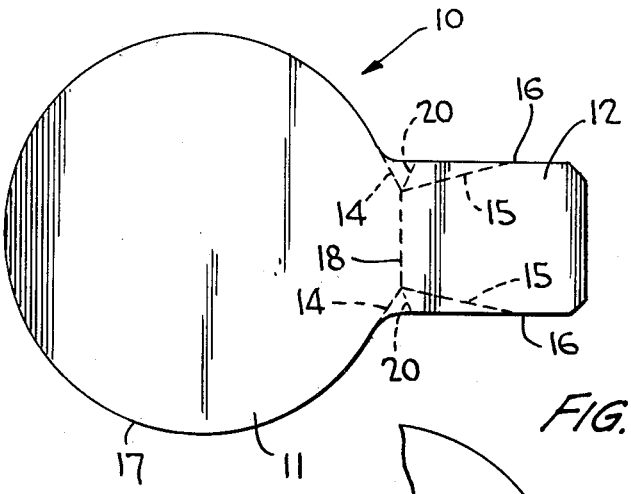

Referring now to the drawings in detail, with reference to FIG. 1 it will now be seen that the tab is generally identified by the numeral 10 and includes a body portion 11 and a grip portion 12. The tab 10 is preferably in the form of an aluminum foil—plastic film laminate with the plastic film serving as means for bonding and the body portion 11 to an underlying end panel by way of a heat seal in a manner to be described hereinafter.

Figure 2:
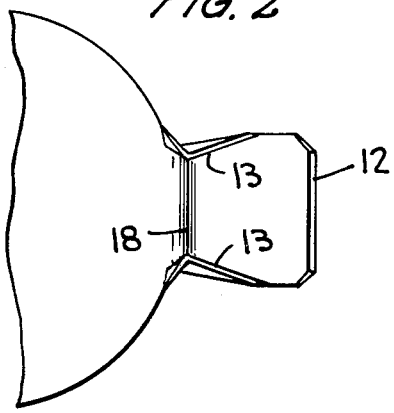
FIG. 2 is a plan view, with parts omitted, similar to FIG. 1, and shows the grip portion partially folded or bent.

This invention particularly relates to the folding of the grip portion 12 relative to the circular outline body portion 11. When the grip portion 12 is folded back over the adjacent body portion 11, in order to facilitate the folding, portions of the grip portion 12 on opposite sides thereof are folded inwardly to define gussets 12 as is best shown in FIG. 2.

Referring once again to FIG. 1, it will be seen that in the areas of the gussets 13 the tab 10 is folded along a plurality of fold lines. Each gusset 13 is defined primarily by two fold lines 14, 15 which, together with a side edge 16 of the grip portion 12, defines a triangular shape. Further, the fold line 14 is disposed substantially tangential to the circular periphery 17 of the body portion 11 at the point where the associated side edge 16 of the grip portion 12 intersects the body portion periphery 17.

Joining the intersections of the fold lines 14, 15 is a fold line 18 which defines the primary line of bend between the grip portion 12 and the body portion 11.

Each gusset 13 is also generally folded upon itself along fold lines 20.

It will be seen that when the tab is inwardly folded on opposite sides of the grip portion 12 simultaneously with the bending of the grip portion 12 relative to the body portion 11, the gussets 13 will be formed and at the same time the fold line 18 will become pronounced. It will become apparent that without reducing the width of the material of the grip portion 12, the width of the grip portion 12 along the fold or bend line 18 may be effectively reduced. Thus, the chordal extent of the fold line 18 is much less than it would be if the grip portion 12 were folded or bent relative to the body portion 11 in the customary manner. The reduced length of the fold line 18 permits the body portion 11 to correspond substantially to the end panel of an associated end unit without notching and thus permits a full size body portion 11 with a maximum strength connection between the grip portion 12 and the body portion 11.

Figure 5:
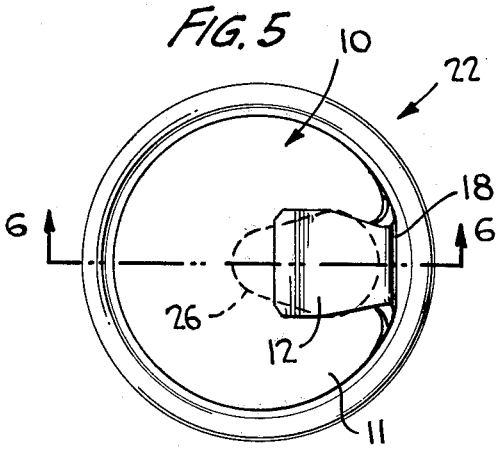
FIG. 5 is a plan view on a reduced scale of an end unit incorporating the tab of FIG. 1.
Figure 3:
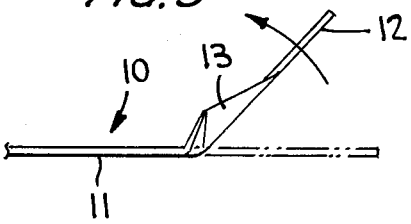
FIG. 3 is a fragmentary side elevational view of FIG. 2, showing more specifically the relationship of the grip portion relative to the body portion and the formation of a gusset alongside the illustrated edge of the grip portion.
Figure 6:
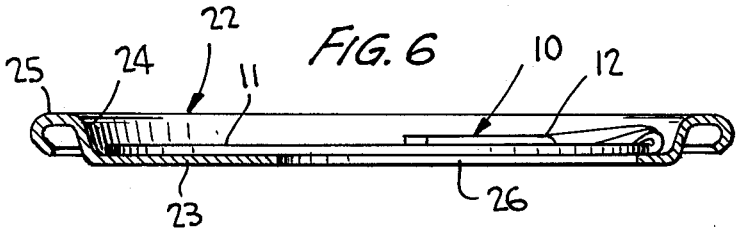
FIG. 6 is an enlarged vertical sectional view taken generally along the line 6—6 of FIG. 5, and shows the specific relationship of the tab with respect to the end unit.

Reference is now made to FIGS. 5 and 6 where it will be seen that there is illustrated a conventional end unit 22 which includes an end panel 23 defined by a chuck wall 24 which, in turn, carries a conventional seaming hook 25. Because of the narrowed length of the fold line 18, the body portion 11 may have its periphery disposed closely adjacent the chuck wall 24 and thus ensure an optimum seal between the body portion 11 and the end panel 23, particularly at the outer end of a dispensing opening 26 formed in the end panel 23.

As aforementioned, the tab 10 is preferably in the form of a laminate of aluminum foil and plastic film The end panel 23 preferably will have a suitable plastic coating thereon, which plastic coating will be heat bondable with the plastic film of the tab 10 when the tab is pressed in place under a combination of heat and pressure.

Figure 4:
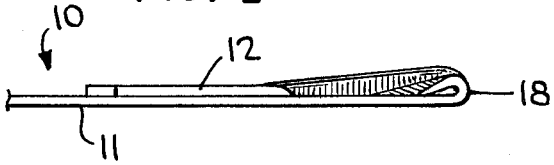
FIG. 4 is an enlarged fragmentary side elevational view of the tab of FIG. 1, with the grip portion fully folded into overlying relation with respect to the body portion.

It will also be apparent that the folding of the tab to define the gussets 13 and the reduced width fold or bend line 18 will result in the forming of a lock-like arrangement on each side of the grip portion 12 which will normally retain the grip portion in tight overlying relation to the body portion 11 as is clearly shown in FIGS. 4 and 6.

Figure 7:
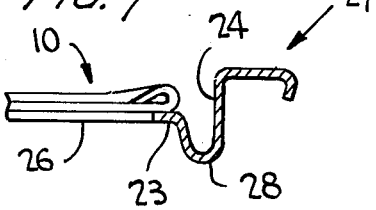
FIG. 7 is an enlarged fragmentary sectional view showing the tab applied to a slightly modified form of end unit.

Referring now to FIG. 7, it will be seen that there is illustrated an end unit generally identified by the numeral 27 which is slightly different from the end unit 22 in that surrounding the end panel 23 and generally within the chuck wall 24 is a peripheral recess defined by a shock absorbing bead 28.

It is further to be understood that while the gusset arrangement is best usable in combination with a full body portion such as the body portion 11, the folds to form the gussets can advantageously be utilized in conventional tabs which cover only a small area of the end panel and which are formed in elongated strip form so as to be generally rectangular and of a constant width.

It is also to be understood that when desired the grip portion 12 may have a suitable finger receiving opening (not shown) therein to facilitate the gripping of the grip portion 12.

Although only preferred embodiments of the invention have been specifically illustrated and described herein, it is to be understood that minor variations may be made in the tab without departing from the spirit and scope of the invention as defined by the appended claims.

I claim:

1. A closure tab comprising a body portion for overlying a container panel and closing an opening in the container panel, and a grip portion extending from said body portion, said grip portion being folded into overlying relation to said body portion, said closure tabs being characterized by fold lines primarily in said grip portion defining an inwardly directed folded gusset at each side of said grip portion at and adjacent to said body portion, said gussets defining a fold line between said grip portion and said body portion of a length materially less than the width of said grip portion, said tab being particularly adapted for overlying a circular end panel of a container end unit with said body portion being circular, said fold lines defining said gussets including fold lines extending substantially tangential to the periphery of said body portion.

2. A closure tab according to claim 1 wherein said fold lines extending substantially tangential to the periphery of said body portion begin at points of intersection of side edges of said grip portion with the periphery of said body portion.

* * * * *